United States Patent [19]

Ike et al.

[11] Patent Number: 4,509,353

[45] Date of Patent: Apr. 9, 1985

[54] METHOD OF AND APPARATUS FOR FORMING GEARS

[75] Inventors: Masahide Ike, Yokosuka; Masashi Arita, Yokohama, both of Japan

[73] Assignee: Nissan Motor Company, Limited, Yokohama, Japan

[21] Appl. No.: 467,603

[22] Filed: Feb. 18, 1983

[30] Foreign Application Priority Data

Mar. 23, 1982 [JP] Japan ..... 57-46108
Sep. 24, 1982 [JP] Japan ..... 57-167111

[51] Int. Cl.[3] ..... B21C 23/18

[52] U.S. Cl. ..... 72/267; 29/159.2; 72/343

[58] Field of Search ..... 72/343, 377, 359, 256, 72/267, 354; 29/159.2

[56] References Cited

U.S. PATENT DOCUMENTS 3,605,475 9/1971 Eakin et al. ..... 29/159.2
3,813,908 6/1974 Roger ..... 72/95
3,910,091 10/1975 Samanta ..... 72/256
4,111,031 9/1978 Vennemeyer ..... 29/159.2

FOREIGN PATENT DOCUMENTS 56-45209 4/1981 Japan .

*Primary Examiner*—Leon Gilden
*Attorney, Agent, or Firm*—Lane, Aitken & Kananen

[57] ABSTRACT

Gears are formed from annular blanks in a gear-forming apparatus including a die block formed with an axial bore and teeth radially projecting into the bore, a cylindrical punch sleeve axially movable toward and away from the bore in the die block, a mandrel movable with the punch sleeve into and out of the bore in the die block, and a backup sleeve axially movable into and out of the bore in the die block in opposite directions to the directions of movement of the sleeve punch and mandrel, wherein gears are formed by preliminarily forcing at least one of the blanks into the bore in the die block until the blank is partially deformed by the teeth of the die block; placing another blank on the preceding blank so that the subsequent blank is received on the preceding blank; causing the mandrel to extend through the respective center holes in the preceding and subsequent blanks; pressing the preceding and subsequent blanks between the end faces of the punch and backup sleeve and forcing the two blanks through the bore in the die block so that the preceding blank is caused to form gear teeth on its outer peripheral surface; and forcing the subsequent blank and the gear resulting from the preceding blank through the bore in the die block for withdrawing the gear out of the bore in the die block.

4 Claims, 8 Drawing Figures

METHOD OF AND APPARATUS FOR FORMING GEARS

FIELD OF THE INVENTION

The present invention relates to a method of forming gears by extrusion of a blank and a gear-forming apparatus to carry out the method.

SUMMARY OF THE INVENTION

In accordance with one outstanding aspect of the present invention, there is provided a method of forming gears from annular blanks each having flat opposite end faces and predetermined inside and outside diameters in a gear-forming apparatus including a die block formed with an axial bore having a diameter slightly larger than the outside diameter of the blanks and a plurality of teeth radially projected into the bore, a hollow cylindrical punch sleeve having a flat end face and a predetermined inside diameter slightly smaller than the inside diameter of the blanks and a predetermined outside diameter substantially equal to the diameter of the bore in the die block, an elongated mandrel having a diameter substantially equal to the inside diameter of the punch sleeve, and a cylindrical backup sleeve having a flat end face and a predetermined outside diameter smaller than the diameter of the deddendum circle of the teeth of the die block, comprising preliminarily forcing at least one of the blanks into the bore in the die block until the blank is partially deformed by the teeth of the die block; placing another one of the blanks on the preceding blank so that the subsequent blank has one of its end faces received on one end face of the preceding blank; causing the mandrel to axially extend through the respective center holes in the preceding and subsequent blanks; pressing the preceding and subsequent blanks between the respective end faces of the punch sleeve and the backup sleeve and forcing the two blanks through the bore in the die block so that the preceding blank is caused to form gear teeth on its outer peripheral surface by the teeth of the die block; and forcing the subsequent blank and the gear resulting from the preceding blank through the bore in the die block for withdrawing the gear out of the bore in the die block. More specifically, a method according to the present invention may comprise preliminarily forcing at least two of the blanks into the bore in the die block until at least one of the two blanks is partially deformed by the teeth of the die block; placing another one of the blanks on the preceding blanks so that the subsequent blank has one of its end faces received on one end face of one of the preceding blanks; causing the mandrel to axially extend through the respective center holes in the preceding and subsequent blanks; pressing the preceding and subsequent blanks between the respective end faces of the punch sleeve and the backup sleeve and forcing the three blanks through the bore in the die block so that at least one of the preceding blanks is caused to form gear teeth on its outer peripheral surface by the teeth of the die block; and forcing the resultant gear and the remaining blanks through the bore in the die block for withdrawing the gear out of the bore in the die block.

In accordance with another outstanding aspect of the present invention, there is provided a gear-forming apparatus, comprising a die block formed with an axial bore having a predetermined diameter and a plurality of teeth radially projecting into the bore; a hollow cylindrical punch sleeve having a flat end face and axially aligned with the bore in the die block, the punch sleeve having a predetermined inside diameter and a predetermined outside diameter substantially equal to the diameter of the bore in the die block; an elongated mandrel axially aligned with the bore in the die block and having a diameter substantially equal to the inside diameter of the punch sleeve; and a cylindrical backup sleeve having a flat end face and a predetermined outside diameter smaller than the diameter of the deddendum circle of the teeth of the die block; the die block and each of the punch sleeve and mandrel being axially movable with respect to each other. More specifically, an apparatus according to the present invention may comprise a stationary die block formed with an axial bore having a predetermined diameter and a plurality of teeth radially projecting into the bore; a hollow cylindrical punch sleeve having a flat end face and axially aligned with the bore in the die block, the punch sleeve having a predetermined inside diameter and a predetermined outside diameter substantially equal to the diameter of the bore in the die block and being axially movable toward and away from one axial end of the bore in the die block; an elongated mandrel axially aligned with the bore in the die block and having a diameter substantially equal to the inside diameter of the punch sleeve; and a cylindrical backup sleeve having a flat end face and a predetermined outside diameter smaller than the diameter of the deddendum circle of the teeth of the die block, the backup sleeve being axially movable into and out of the bore in the die block through the other axial end of the bore.

BRIEF DESCRIPTION OF THE DRAWINGS

The drawbacks of a prior-art method of and an apparatus for forming gears and the features and advantages of a method and a gear-forming apparatus according to the present invention will be more clearly understood from the following description taken in conjunction with the accompanying drawings in which.

DESCRIPTION OF THE PRIOR ART

Figure 1:
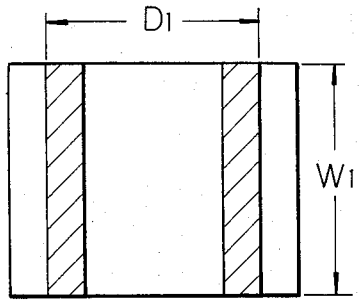
FIGS. 1 and 2 are axial sectional views showing examples of gears having different dimensions.
Figure 2:
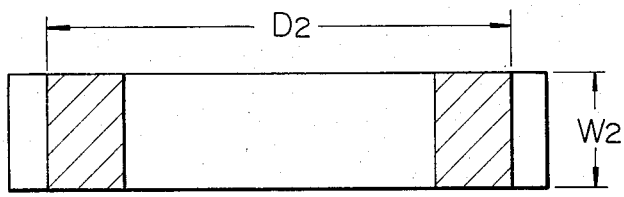
Figure 3:
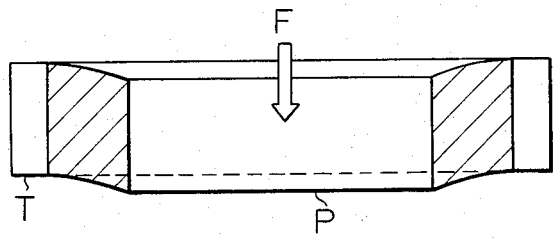
FIG. 3 is a view similar to FIG. 2 but shows a gear produced by a prior-art method of forming gears.

There are known various methods of forming gears by extrusion of blanks through die blocks formed with internal teeth. In a gear forming process taught in, for example, U.S. Pat. No. 3,910,091 or Japanese Provisional Patent Publication No. 56-45209, an annular or cylindrical blank of metal is forced halfway through a gear-forming die with such teeth and, thereafter, another similarly shaped blank is positioned on the preceding blank. Thereupon, the two blanks are concurrently forced through the die so that the preceding blank is caused to form gear teeth on the outer peripheral surface thereof. Such a gear-forming process is suitable for the formation of a gear when the diameter $D_1$ of the deddendum circle of the gear to be produced is approximately equal to or slightly larger than the face width $W_1$ of the gear as shown in FIG. 1. If, however, the diameter $D_2$ of the deddendum circle of the gear to be produced is appreciably larger than the face width $W_2$ of the gear as shown in FIG. 2, the material of the blank being forced through the die is caused to flow forwardly more rapidly in those portions of the blank which are to be left plain than in the tooth-forming portions of the blank which are forced to slide on the surfaces of the teeth of the die. It therefore follows that the portions of the resultant gear which are to be left plain tend to protrude in the direction in which the force is axially applied to the blank, as shown exaggerated in FIG. 3. In FIG. 3, the gear is shown having teeth T and portions P which are caused to protrude in the direction in which the force is applied to the blank as indicated by arrow F.

The present invention contemplates resolution of the problem encountered in a prior-art gear-forming process in which the gear produced tends to have objectionably deformed portions.

DESCRIPTION OF THE PREFERRED EMBODIMENTS

Figure 4:
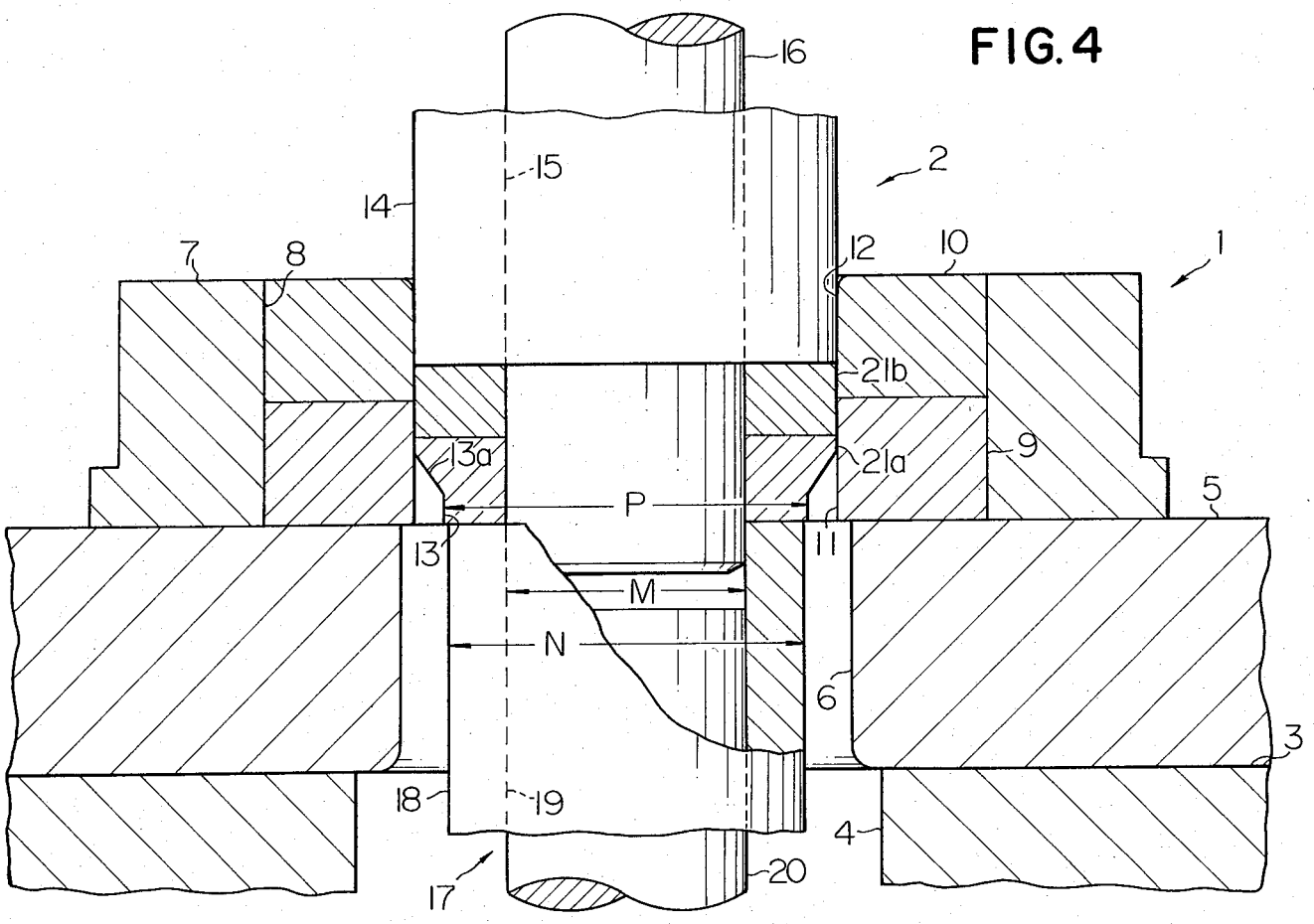
FIGS. 4 and 5 are vertical sectional views showing a preferred embodiment of a gear-forming apparatus according to the present invention.

Referring to FIG. 4 of the drawings, a gear-forming apparatus embodying the present invention comprises a lower stationary die assembly 1 and an upper movable punch assembly 2 which is positioned above the die assembly 1. The punch assembly 2 is in its entirety movable downwardly toward and upwardly away from the die assembly 1, although only the major component members of the punch assembly 2 are herein shown. The stationary die assembly 1 comprises a support block 3 held stationary on a floor surface (not shown) and formed with a vertical bore 4 which is open at the upper and lower ends thereof. An annular lower backup member 5 having a horizontal, flat upper face is closely received on the support block 3 and is formed with an opening 6 having a circular cross section and axially aligned with and open at the lower end thereof to the bore 4 in the support block 3. The lower backup member 5 in turn has supported on the upper end face thereof a cylindrical bearing socket member 7 formed with a bore 8 which is axially aligned with the opening 6 in the lower backup member 5 and the bore 4 in the support block 3. The bearing socket member 7 is securely coupled to the support block 3 by suitable fastening means (not shown). An annular die block 9 is closely received on a lower portion of the inner peripheral surface of the bearing socket member 7 and on the upper face of the lower backup member 5. The die block 9 has an axial length larger than the face width of the gears to be produced and, accordingly, the thickness of the blanks to be deformed into the gears. A bearing ring 10 is likewise closely received on an upper portion of the inner peripheral surface of the bearing socket member 7 and on the upper face of the die block 9. The die block 9 and bearing ring 10 are formed with bores 11 and 12, respectively, having circular cross sections with predetermined equal diameters smaller than the opening 6 in the lower backup member 5 and the bore 4 in the support block 3. The bore 11 in the die block 9 is open at the lower end thereof to the opening 6 in the lower backup member 5 and, likewise, the bore 12 in the bearing ring 10 is open at the lower end thereof to the bore 11 in the die block 9. The die block 9 is formed with teeth such as helical teeth 13 radially projecting into the bore 11 in the block 9 and having lead-in portions **13*a* which are directed toward the upper end of the die block 9 and which have heights gradually reduced toward the bore 12 in the bearing ring 10** as shown.

On the other hand, the punch assembly 2 comprises a generally cylindrical punch sleeve 14 fixedly attached to the lower face of an upper backup member (not shown). The punch sleeve 14 has a flat lower end face and is formed with an axial bore 15 having a circular cross section with a predetermined diameter and a center axis aligned with the respective center axes of the bores 11 and 12 in the die block 9 and bearing ring 10, respectively. The punch sleeve 14 has an outer peripheral surface having a diameter substantially equal to the diameters of the respective bores 11 and 12 in the die block 9 and bearing ring 10 and is axially slidable through the bore 12 in the bearing ring 10. The punch assembly 2 further comprises an elongated mandrel 16 which is closely received in the bore 15 in the punch sleeve 14 and has an upper end face also securely attached to the lower face of the upper backup member (not shown). The mandrel 16 has a lower end portion projecting downwardly from the bore 15 in the punch sleeve 14 and axially slidable downwardly into and upwardly out of the bores 11 and 12 in the die block 9 and bearing ring 10, respectively. The center axis of the mandrel 16 is aligned with the respective center axes of the bores 11 and 12 in the die block 9 and bearing ring 10. The outside diameter of the punch sleeve 14 and accordingly the inside diameters of the die block 9 and bearing ring 10 are substantially equal to the diameter of the gear or, more exactly, the diameter of the addendum circle of the gear to be formed. Furthermore, the inside diameter of the punch sleeve 14 and accordingly the diameter of the mandrel 16 are selected to be substantially equal to the diameter of the center holes of the gears to be formed.

In accordance with the present invention, the gear-forming apparatus further comprises a counter press assembly 17 which is movable in its entirety upwardly into and downwardly out of the bore 11 in the die block 9 through the opening 6 in the support block 3. The counter press assembly 17 comprises a cylindrical backup sleeve 18 having a flat upper end face and formed with an axial bore 19 having a circular cross section with a diameter M equal to the diameter of the bore 15 in the punch sleeve 14 and a center axis aligned with the respective center axes of the bores 11 and 12 in the die block 9 and bearing ring 10, respectively. The backup sleeve 18 further has an outside diameter N slightly smaller than the diameter P of the deddendum circle of the gears to be formed. The counter press assembly 17 further comprises an elongated plunger 20 which is fixedly received in the bore 19 in the backup sleeve 18 and which has a flat upper end face terminating a predetermined distance short of the upper end of the backup sleeve 18. The plunger 20 has a circular cross section having a diameter equal to the diameter of the mandrel 16 and the inside diameters M of the punch sleeve 14 and backup sleeve 18.

Though not shown in the drawings, the upper backup member having the punch sleeve 14 securely attached thereto is operatively connected to suitable drive means adapted to drive the punch assembly 2 to move upwardly and downwardly with respect to the lower die assembly 1. Similarly, the backup sleeve 18 and plunger 20 are operatively connected to suitable drive means also adapted to drive the backup sleeve 18 and plunger 20 for vertical movement with respect to the die assembly 1 through the bore 4 in the support block 3.

The blanks to be deformed into gears in the apparatus thus constructed and arranged are preliminarily prepared so that each blanks has an outside diameter slightly smaller than the inside diameters of the die block 9 and bearing ring 10 and an inside diameter slightly larger than the inside diameters of the punch sleeve 14 and backup sleeve 18 and accordingly the diameters of the mandrel 16 and plunger 20. Such gears are thus fabricated from blanks which are preliminarily worked to have outside diameters slightly smaller than the inside diameters of the die block 9 and bearing ring 10 and the outside diameter of the punch sleeve 14 and inside diameters slightly larger than the inside and outside diameters of the punch sleeve 14 and mandrel 16, respectively.

Figure 5:
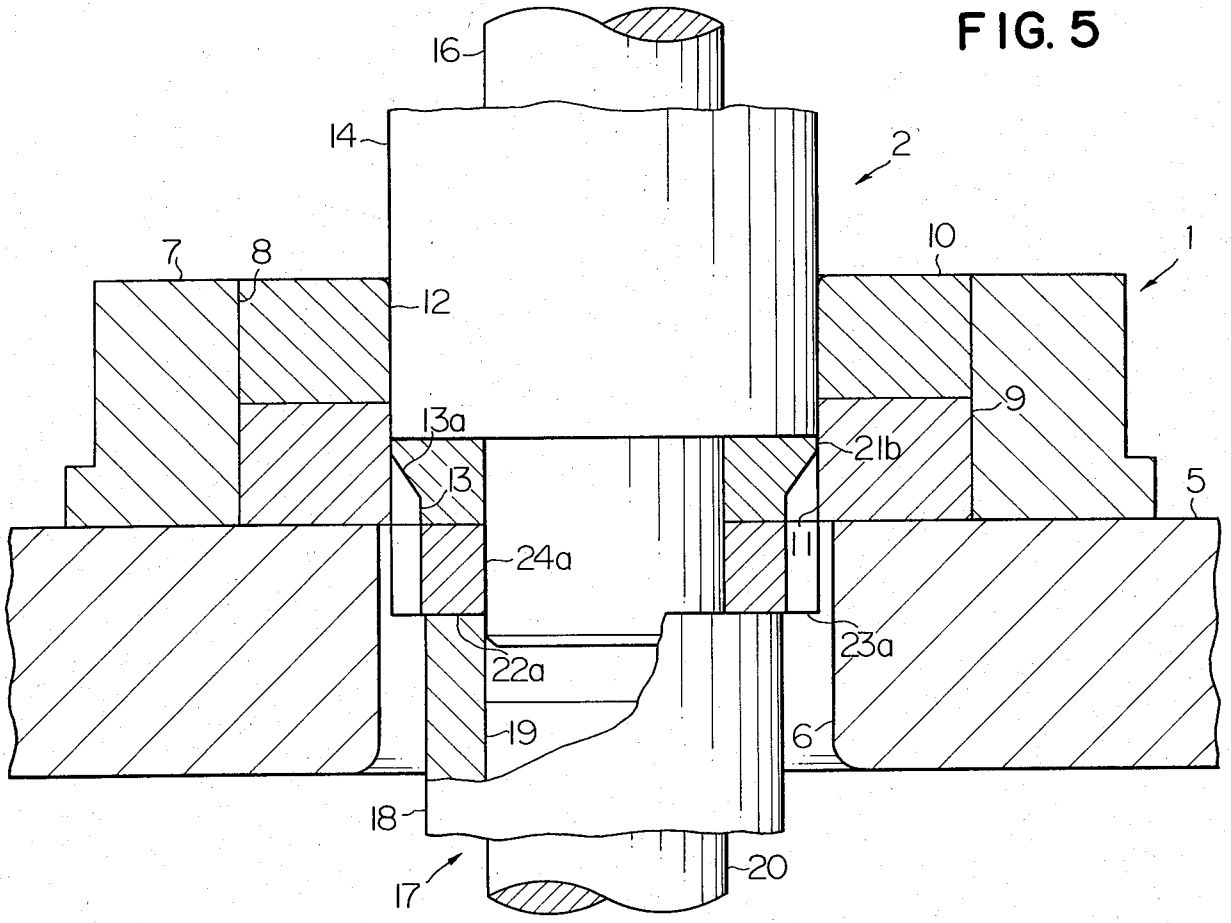

To fabricate gears from such blanks, the upper punch assembly 2 is first held in a predetermined vertical position above the lower die assembly 1 so that the punch sleeve 14 and the mandrel 16 of the punch assembly 2 are withdrawn upwardly from the respective bores 11 and 12 in the die block 9 and the bearing ring 10 of the die assembly 1. On the other hand, the counter press assembly 17 is held in a predetermined vertical position having the upper end face of the backup sleeve 18 located at or below the lower end of the die block 9 and the upper end face of the plunger 20 located below the axial bore 11 in the die block 9. An annular blank 21*a*, which is one of the blanks preliminarily prepared as above described, is put into the bore 11 in the die block 9. The blank 21*a* thus rests on the lead-in portions 13*a* of the teeth 13 of the die block 9 and is positioned partially in the bore 11 in the die block 9 and partially in the bore 12 in the bearing ring 10. The punch assembly 2 as a whole is then driven to move downwardly so that the mandrel 16 of the punch assembly 2 is passed downwardly through the center hole in the blank 21*a* and projects from the blank 21*a* into the bore 11 in the die block 9 or through the bore 11 in the die block 9 into the bore 19 in the backup sleeve 18, depending upon the length of the mandrel 16 with respect to the punch sleeve 14 and/or the vertical position of the backup sleeve 18 with respect to the die assembly 1. As the mandrel 16 is moved downwardly through the center hole in the blank 21*a*, the punch sleeve 14 is moved into the bore 12 in the bearing ring 10 toward the upper end face of the blank 21*a*. While the punch sleeve 14 is being thus moved toward the blank 21*a*, the counter press assembly 17 is driven to move upwardly so that the backup sleeve 18 is moved into the bore 11 in the die block 9 toward the lower end face of the blank 21*a*. When the counter press assembly 17 reaches a certain vertical position with respect to the die assembly 1, the backup sleeve 18 has its upper end face brought into abutting contact with the lower end face of the blank 21*a*. Simultaneously when the backup sleeve 18 is thus brought into contact with the blank 21*a*, the punch assembly 2 reaches a certain vertical position with respect to the die assembly 1 so that the punch sleeve 14 has its lower end face brought into abutting contact with the upper end face of the blank 21*a*. The blank 21*a* is now pressed upon in opposite directions by and between the punch sleeve 14 and backup sleeve 18. The respective drive means for the punch assembly 2 and the counter press assembly 17 are designed so that the force exerted on the blank 21*a* by the punch assembly 2 slightly overcomes the opposing force exerted on the blank 21*a* by the counter press assembly 17. The blank 21*a* is for this reason forced to move downwardly in the bores 11 and 12 in the die block 9 and bearing ring 10, respectively, and to ride on the lead-in portions 13*a* of the teeth 13 of the die block 9. The punch assembly 2 and the counter press assembly 17 are at this stage brought to rest so that the blank 21*a* interposed between the punch sleeve 14 and backup sleeve 18 is released from the pressuring forces. The punch assembly 2 and counter press assembly 17 are thereafter driven upwardly and downwardly, respectively, to their initial positions so that the mandrel 16 is withdrawn from the center hole in the blank 21*a* and the backup sleeve 18 has its upper end face located below the blank 21*a*. A second annular blank 21*b* is then put into the axial bore 12 in the bearing ring 10 and is thus received on the upper end face of the preceding blank 21*a*. Thereupon, the punch assembly 2 is for a second time driven to move downwardly so that the mandrel 16 is passed downwardly through the center hole in the upper subsequent blank 21*b* and the center hole in the lower preceding blank 21*a* and projects from the lower preceding blank 21*a* into the bore 11 in the die block 9 or through the bore 11 in the die block 9 into the bore 19 in the backup sleeve 18. As the mandrel 16 is moved downwardly through the center hole in the blank 21*a*, the punch sleeve 14 is moved into the bore 12 in the bearing ring 10 toward the upper end face of the upper subsequent blank 21*b*. While the punch sleeve 14 is being thus moved toward the upper subsequent blank 21*b*, the counter press assembly 17 is driven to move upwardly so that the backup sleeve 18 is moved into the bore 11 in the die block 9 toward the lower end face of the lower preceding blank 21*a*. When the counter press assembly 17 reaches a certain vertical position with respect to the die assembly 1, the backup sleeve 18 has its upper end face brought into abutting contact with the lower end face of the blank 21*a*. Simultaneously when the backup sleeve 18 is thus brought into contact with the blank 21*a*, the punch assembly 2 also reaches a certain vertical position with respect to the die assembly 1 so that the punch sleeve 14 has its lower end face brought into abutting contact with the upper end face of the upper subsequent blank 21*b*. The blanks 21*a* and 21*b* are now pressed upon in opposite directions by and between the punch sleeve 14 and backup sleeve 18. The force exerted on the blanks 21*a* and 21*b* by the counter press assembly 17 being overcome by the opposing force exerted on the blanks 21*a* and 21*b* by the punch assembly 2, the blanks 21*a* and 21*b* are forced to move downwardly in the bores 11 and 12 in the die block 9 and bearing ring 10, respectively, with the result that the lower preceding blank 21*a* is caused to move through the bore 11 in the die block 9 and to form teeth progressively between the lead-in portions 13*a* of the teeth 13 of the die block 9. The lower preceding blank 21*a* is further forced to move through the bore 11 in the die block 9 and is caused to finally form the gear teeth thereon by the teeth 13 of the die block 9. A helical gear 22*a* having helically extending teeth 23*a* and a center hole 24*a* is thus withdrawn from the die block 9 into the opening 6 in the backup member 5 as shown in FIG. 5. The blank 21*a* thus forced out of the bore 11 in the die block 9 is tightly retained to the mandrel 16 and is closely received between the lower end face of the upper subsequent blank 21*b* and the upper end face of the backup sleeve 18. While the lower preceding blank 21*a* is being forced through the bore 11 in the die block 9, the upper subsequent blank 21*a* interposed between the lower end face of the punch sleeve 14 and the upper end face of the lower preceding blank 21*a* is forced into the bore 11 and is progressively deformed by the teeth 13 of the die block 9.

After the gear 22*a* is withdrawn from the bore 11 in the die block 9 as above described, the punch assembly 2 is driven to move upwardly and the counter press assembly 17 is driven to move downwardly with respect to the die assembly 1. The punch assembly 2 being driven to move upwardly, the mandrel 16 is forced out of the center hole 24*a* in the gear 22*a* so that the gear 22*a* resulting from the lower preceding blank 21*a* is allowed to move downwardly on the upper end face of the backup sleeve 18 as the counter press assembly 17 is driven to move downwardly. The gear 22*a* on the backup sleeve 18 can thus be removed therefrom when the counter press assembly 17 is brought to a stop or while the counter press assembly 17 is being moved downwardly. The subsequent blank 21*b* disengaged from the punch sleeve 14 and mandrel 16 of the punch assembly 2 is retained to the teeth 13 of the die block 9 and remains in the bore 11 in the die block 9. After the punch assembly 2 and counter press assembly 17 are thereafter brought to rest, a third blank (not shown) is put into the axial bore 12 in the bearing ring 10 and is thus received on the preceding blank 21*b* which is partially deformed. The punch assembly 2 and counter press assembly 17 are then driven to move downwardly and upwardly so that the lower preceding blank 21*b* is completely deformed into a helical gear (not shown) and the upper subsequent blank 21*c* is progressively deformed by the teeth 13 of the die block 9 as above described in connection with the first and second blanks 21*a* and 21*b*.

The gear-forming apparatus embodying the present invention as hereinbefore described is thus capable of successively working two blanks during each cycle of operation of the apparatus. One of the two blanks, viz., the lower preceding blank is completely deformed into a gear and the other of the blanks, viz., the upper subsequent blank is partially deformed into the form of a gear during each cycle of operation. The lower preceding blank being completely deformed into a gear is pressed upon in opposite directions between the lower end face of the upper subsequent blank and the upper end face of the backup sleeve 18 of the counter press assembly 17, while the upper subsequent blank being partially deformed into the form of a gear is pressed upon in opposite directions between the upper end face of the lower preceding blank and the lower end face of the punch sleeve 14 of the punch assembly 2. Each of the two blanks is, in this fashion, caused to have its opposite end faces pressed upon in opposite directions and is, for this reason, prohibited from being deformed irregularly in the axial direction thereof.

Figure 6:
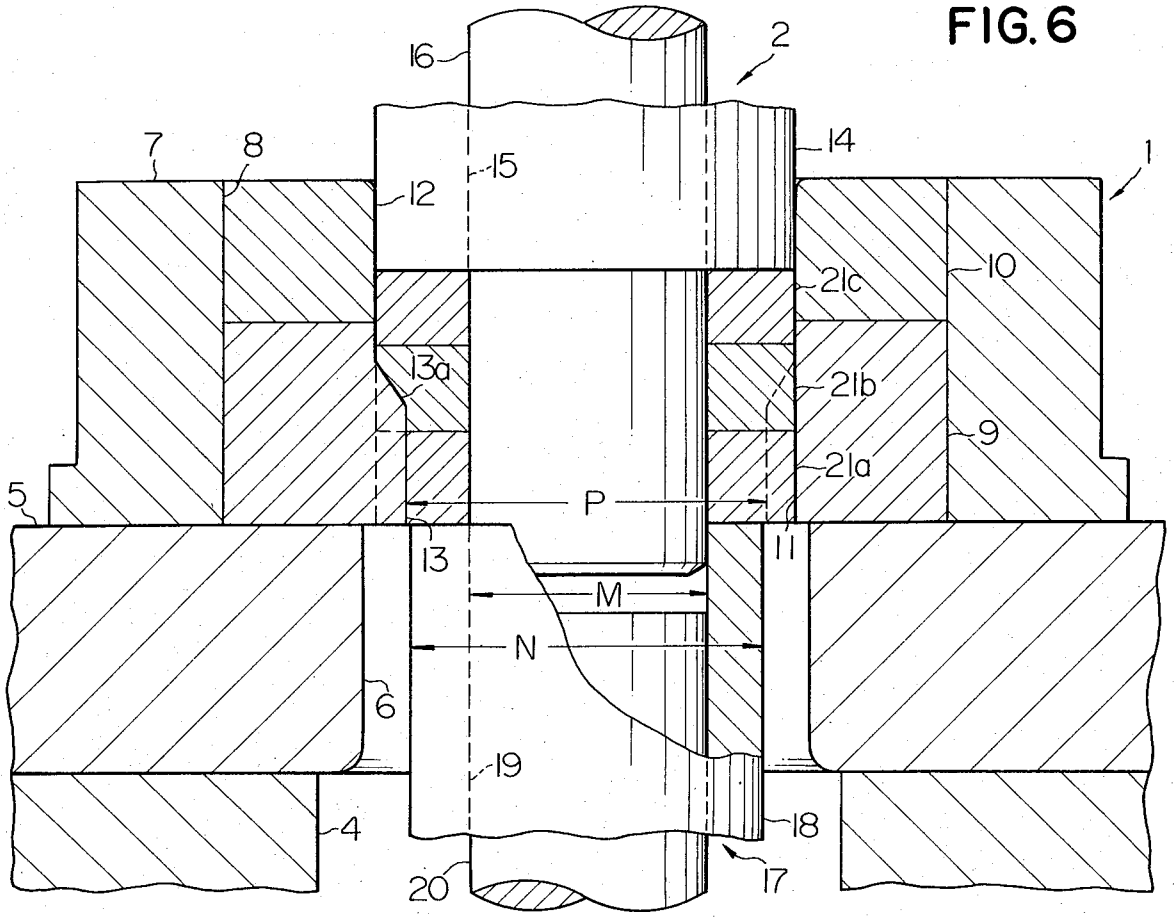
FIGS. 6 and 7 are vertical sectional views showing a modification of the embodiment shown in FIGS. 4 and 5.
Figure 7:
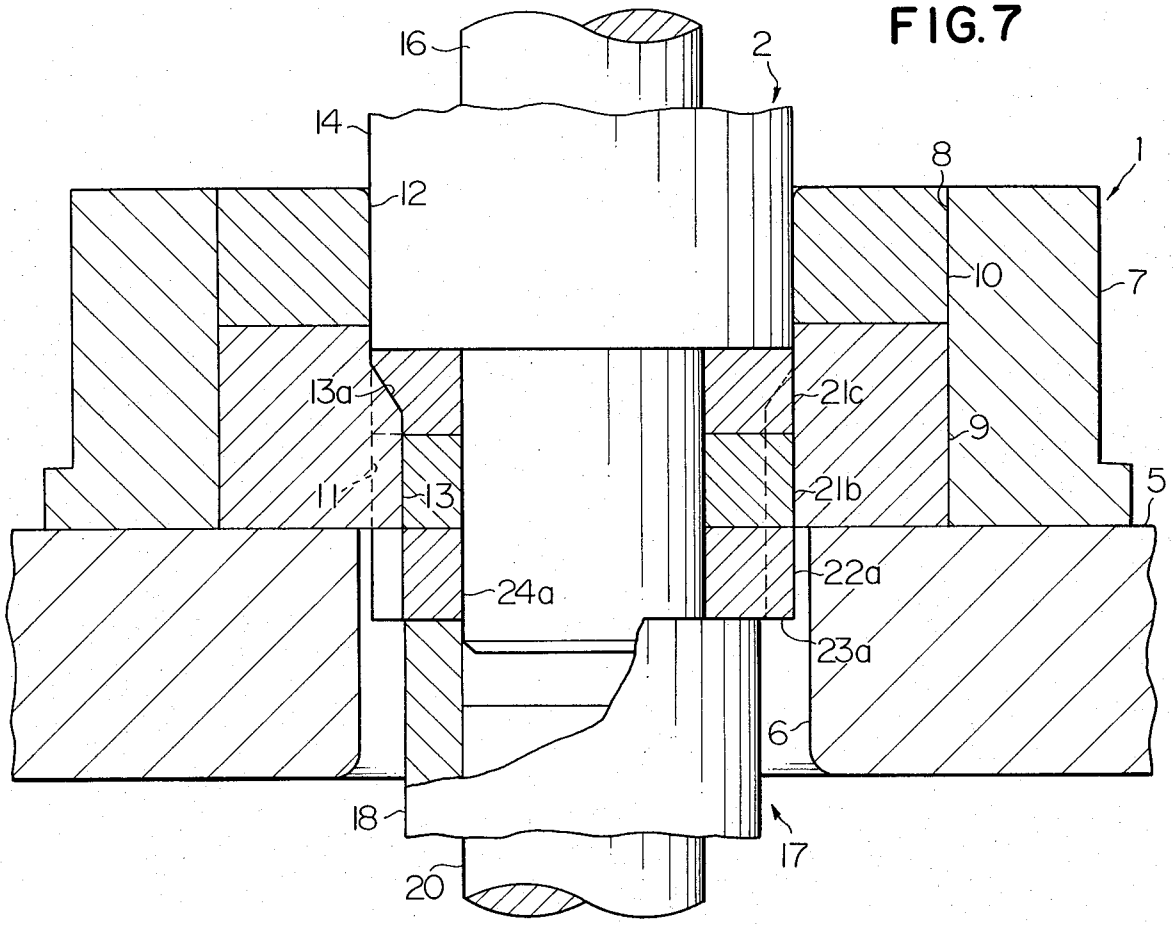

If desired, the gear-forming apparatus embodying the present invention can be used to successively work three or four blanks during each cycle of operation thereof. FIGS. 6 and 7 of the drawings show the apparatus used for this purpose. The die block 9 of the apparatus herein shown has an axial length larger than two times the face width of the gears to be formed, in contrast to the die assembly 1 in the apparatus shown in FIGS. 4 and 5 in which the axial length of the die block 9 is larger than the face width of the gears to be produced and smaller than two times the face width of the gears.

Prior to the start of such operation in the apparatus shown in FIGS. 6 and 7, the upper punch assembly 2 is held in a certain vertical position above the lower die assembly 1 so that the punch sleeve 14 and the mandrel 16 of the punch assembly 2 are withdrawn upwardly from the respective bores 11 and 12 in the die block 9 and the bearing ring 10 of the die assembly 1. On the other hand, the counter press assembly 17 is held in a predetermined vertical position having the upper end face of the backup sleeve 18 located at or below the lower end of the die block 9 and the upper end face of the plunger 20 located below the axial bore 11 in the die block 9. An annular blank 21*a* is put into the bore 11 in the die block 9. The blank 21*a* thus rests on the lead-in portions 13*a* of the teeth 13 of the die block 9 and is positioned partially in the bore 11 in the die block 9 and partially in the bore 12 in the bearing ring 10. The punch assembly 2 as a whole is then driven to move downwardly so that the mandrel 16 of the punch assembly 2 is passed downwardly through the center hole in the blank 21*a* and projects from the blank 21*a* into the bore 11 in the die block 9 or through the bore 11 in the die block 9 into the bore 19 in the backup sleeve 18, depending upon the length of the mandrel 16 with respect to the punch sleeve 14 and/or the vertical position of the backup sleeve 18 with respect to the die assembly 1. As the mandrel 16 is moved downwardly through the center hole in the blank 21*a*, the punch sleeve 14 is moved into the bore 12 in the bearing ring 10 toward the upper end face of the blank 21*a*. While the punch sleeve 14 is being thus moved toward the blank 21*a*, the counter press assembly 17 is driven to move upwardly so that the backup sleeve 18 is moved into the bore 11 in the die block 9 toward the lower end face of the blank 21*a*. When the counter press assembly 17 reaches a certain vertical position with respect to the die assembly 1, the backup sleeve 18 has its upper end face brought into abutting contact with the lower end face of the blank 21*a*. Simultaneously when the backup sleeve 18 is thus brought into contact with the blank 21*a*, the punch assembly 2 reaches a certain vertical position with respect to the die assembly 1 so that the punch sleeve 14 has its lower end face brought into abutting contact with the upper end face of the blank 21*a*. The blank 21*a* is now pressed upon in opposite directions by and between the punch sleeve 14 and backup sleeve 18. The force exerted on the blank 21*a* by the counter press assembly 17 being overcome by the force exerted on the blank 21*a* by the punch assembly 2, the blank 21*a* is forced to move downwardly in the bores 11 and 12 in the die block 9 and bearing ring 10, respectively, and to ride on the lead-in portions 13*a* of the teeth 13 of the die block 9. The punch assembly 2 and counter press assembly 17 are then brought to rest so that the blank 21*a* interposed between the punch sleeve 14 and backup sleeve 18 is released from the pressing forces. The punch assembly 2 and counter press assembly 17 are thereafter driven upwardly and downwardly, respectively, to their initial positions so that the mandrel 16 is withdrawn from the center hole in the blank 21*a* and the backup sleeve 18 has its upper end face located below the blank 21*a*.

A second annular blank 21*b* is then put into the axial bore 12 in the bearing ring 10 and is thus received on the upper end face of the preceding blank 21*a*. Thereupon, the punch assembly 2 is for a second time driven to move downwardly so that the mandrel 16 is passed downwardly through the center hole in the upper subsequent blank 21*b* and the center hole in the lower preceding blank 21*a* and projects from the lower preceding blank 21*a* into the bore 11 in the die block 9 or through the bore 11 in the die block 9 into the bore 19 in the backup sleeve 18. As the mandrel 16 is moved downwardly through the respective center holes in the blanks 21*a* and 21*b*, the punch sleeve 14 is moved into the bore 12 in the bearing ring 10 toward the upper end face of the upper subsequent blank 21*b*. While the punch sleeve 14 is being thus moved toward the upper subsequent blank 21*b*, the counter press assembly 17 is driven to move upwardly so that the backup sleeve 18 is moved into the bore 11 in the die block 9 toward the lower end face of the lower preceding blank 21*a*. When the counter press assembly 17 reaches a certain vertical position with respect to the die assembly 1, the backup sleeve 18 has its upper end face brought into abutting contact with the lower end face of the blank 21*a*. Simultaneously when the backup sleeve 18 is brought into contact with the blank 21*a*, the punch assembly 2 also reaches a certain vertical position with respect to the die assembly 1 so that the punch sleeve 14 has its lower end face brought into abutting contact with the upper end face of the upper subsequent blank 21*b*. The blanks 21*a* and 21*b* are now pressed upon in opposite directions by and between the punch sleeve 14 and backup sleeve 18. The blanks 21*a* and 21*b* are thus forced to move downwardly in the bores 11 and 12 in the die block 9 and bearing ring 10, respectively, with the result that the lower preceding blank 21*a* is caused to move through the bore 11 in the die block 9 and to form helical teeth progressively between the lead-in portions 13*a* of the teeth 13 of the die block 9. The punch assembly 2 and counter press assembly 17 are then brought to rest so that the partially worked blanks 21*a* and 21*b* interposed between the punch sleeve 14 and backup sleeve 18 are released from the pressing forces. The punch assembly 2 and counter press assembly 17 are thereafter driven upwardly and downwardly, respectively, to their initial positions so that the mandrel 16 is withdrawn from the respective center holes in the blanks 21*a* and 21*b* and the backup sleeve 18 has its upper end face located below the lower preceding blank 21*a*.

A third annular blank 21*c* is then put into the axial bore 12 in the bearing ring 10 and is thus received on the upper end face of the preceding blank 21*b*. Thereupon, the punch assembly 2 is driven to move downwardly so that the mandrel 16 is passed downwardly through the respective center holes in the three blanks 21*a*, 21*b* and 21*c* and projects from the lowermost blank 21*a* into the bore 11 in the die block 9 or through the bore 11 in the die block 9 into the bore 19 in the backup sleeve 18. As the mandrel 16 is moved downwardly through the respective center holes in the blank 21*a*, 21*b* and 21*c*, the punch sleeve 14 is moved into the bore 12 in the bearing ring 10 toward the upper end face of the uppermost blank 21*c*. While the punch sleeve 14 is being thus moved toward the uppermost blank 21*c*, the counter press assembly 17 is driven to move upwardly so that the backup sleeve 18 is moved into the bore 11 in the die block 9 toward the lower end face of the lowermost blank 21*a*. When the counter press assembly 17 reaches a certain vertical position with respect to the die assembly 1, the backup sleeve 18 has its upper end face brought into abutting contact with the lower end face of the blank 21*a*. Simultaneously when the backup sleeve 18 is brought into contact with the blank 21*a*, the punch assembly 2 also reaches a certain vertical position with respect to the die assembly 1 so that the punch sleeve 14 has its lower end face brought into abutting contact with the upper end face of the uppermost blank 21*c*. The blanks 21*a*, 21*b* and 21*c* are now pressed upon in opposite directions by and between the punch sleeve 14 and backup sleeve 18. The blanks 21*a*, 21*b* and 21*c* are thus forced to move downwardly in the bores 11 and 12 in the die block 9 and bearing ring 10, respectively, with the result that the two lower preceding blanks 21*a* and 21*b* are caused to move through the bore 11 in the die block 9 and to further form helical teeth progressively between the lead-in portions 13*a* of the teeth 13 of the die block 9 and, concurrently, the uppermost blank 21*c* is caused to move toward the upper ends of the lead-in portions 13*a* of the teeth 13 as shown in FIG. 6. The lowermost blank 21*a* is further forced to move through the bore 11 in the die block 9 and is caused to finally form helical gear teeth thereon by the teeth 13 of the die block 9. A helical gear 22*a* having helically extending teeth 23*a* and a center hole 24*a* is thus withdrawn from the die block 9 into the opening 6 in the backup member 5 as shown in FIG. 7. The blank 21*a* thus forced out of the bore 11 in the die block 9 is closely received between the lower end face of the intermediate blank 21*b* and the upper end face of the backup sleeve 18. While the lowermost blank 21*a* is being forced through the bore 11 in the die block 9, the intermediate blank 21*b* is forced through the bore 11 and is progressively deformed by the teeth 13 of the die block 9 and concurrently the uppermost blank 21*c* is forced to move downwardly in the bores 11 and 12 in the die block 9 and bearing ring 10, respectively, and to ride on the lead-in portions 13*a* of the teeth 13 of the die block 9. The punch assembly 2 and counter press assembly 17 are then brought to rest so that the blanks 21*a* and 21*b* and the gear 22*a* resulting from the blank 21*a* are released from the pressing forces. The punch assembly 2 and counter press assembly 17 are thereafter driven upwardly and downwardly, respectively, to their initial positions so that the mandrel 16 is withdrawn from the center holes in the blanks 21*b* and 21*c* and the gear 22*a* and the backup sleeve 18 has its upper end face located below the gear 22*a*. The gear 22*a* thus resting on the upper end face of the backup sleeve 18 is then withdrawn therefrom and a fourth annular blank (not shown) is put into the axial bore 12 in the bearing ring 10 and is thus received on the upper end face of the preceding blank 21*c*. A number of gears are thus produced by repetition of the third cycle of operation.

Figure 8:
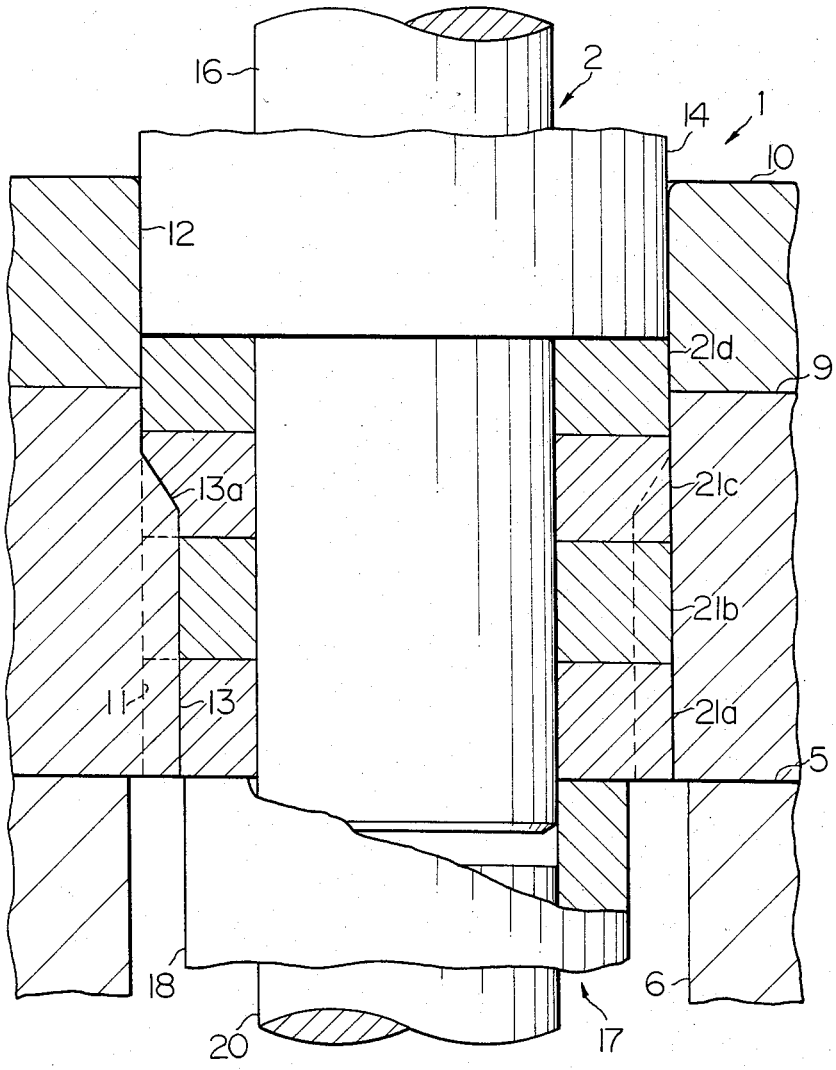
FIG. 8 is a vertical sectional view showing another modification of the embodiment shown in FIGS. 4 and 5.

If desired, the gear-forming apparatus embodying the present invention can be used to successively work four or more blanks during each cycle of operation thereof. FIG. 8 of the drawings shows a gear-forming apparatus in which the die block 9 is sized to have an axial length larger than three times the face width of the gears to be formed. The gear-forming apparatus herein shown is thus adapted to work four blanks 21*a*, 21*b*, 21*c* and 21*d* during each cycle of operation thereof.

While it has been described that the mandrel 16 is closely received in the bore 15 in the punch sleeve 14 and that the plunger 20 is fixedly received in the bore 19 in the backup sleeve 18, the mandrel 16 may be closely received in the bore 19 in the backup sleeve 18 according to the present invention. In this instance, the plunger 20 is fixedly received in the bore 15 in the punch sleeve 14.

What is claimed is:

1. A method of forming gears from annular blanks each having flat opposite end faces and predetermined inside and outside diameters in a gear-forming apparatus including a die block formed with an axial bore having a diameter slightly larger than the outside diameter of the blanks and a plurality of teeth radially projecting into the bore, a hollow cylindrical punch sleeve having a flat end face and a predetermined inside diameter slightly smaller than the inside diameter of the blanks and a predetermined outside diameter substantially equal to the diameter of the bore in the die block, an elongated mandrel having a diameter substantially equal to the inside diameter of the punch sleeve, and a cylindrical backup sleeve having a flat end face and a predetermined outside diameter smaller than the diameter of the deddendum circle of said teeth, the punch sleeve and the backup sleeve being axially movable with respect to each other and to said die block, comprising:

preliminarily forcing at least one of the blanks into the bore in the die block until the blank is partially deformed by said teeth;

placing another one of the blanks on the preceding blank so that the subsequent blank has one of its end faces received on one end face of the preceding blank;

causing said mandrel to axially extend through the respective center holes in the preceding and subsequent blanks;

pressing the preceding and subsequent blanks between the respective end faces of said punch sleeve and said backup sleeve and forcing the two blanks through the bore in the die block so that the preceding blank is caused to form gear teeth on its outer peripheral surface by the teeth of the die block; and forcing the subsequent blank and the gear resulting from the preceding blank through the bore in the die block for withdrawing the gear out of the bore in the die block, wherein each of the blanks in the axial bore in the die block is axially pressed upon in one direction by means of said punch sleeve and in the opposite direction by means of said backup sleeve and is forced to move in the former direction through the axial bore in the die block.

2. A method of forming gears from annular blanks each having flat opposite end faces and predetermined inside and outside diameters in a gear-forming apparatus including a die block formed with an axial bore having a diameter slightly larger than the outside diameter of the blanks and a plurality of teeth radially projecting into the bore, a hollow cylindrical punch sleeve having a flat end face and a predetermined inside diameter slightly smaller than the inside diameter of the blanks and a predetermined outside diameter substantially equal to the diameter of the bore in the die block, an elongated mandrel having a diameter substantially equal to the inside diameter of the punch sleeve, and a cylindrical backup sleeve having a flat end face and a predetermined outside diameter smaller than the diameter of the deddendum circle of said teeth, the punch sleeve and the backup sleeve being axially movable with respect to each other and to said die block, comprising:

preliminarily forcing at least one of the blanks into the bore in the die block until at least one of the two blanks is partially deformed by said teeth;

placing another one of the blanks on the preceding blanks so that the subsequent blank has one of its end faces received on one end face of the preceding blanks;

causing said mandrel to axially extend through the respective center holes in the preceding and subsequent blanks;

pressing the preceding and subsequent blanks between the respective end faces of said punch sleeve and said backup sleeve and forcing the three blanks through the bore in the die block so that at least one of the preceding blanks is caused to form gear teeth on its outer peripheral surface by the teeth of the die block; and forcing the resultant gear and the remaining blanks through the bore in the die block for withdrawing the gear out of the bore in the die block, wherein each of the blanks in the axial bore in the die block is axially pressed upon in one direction by means of said punch sleeve and in the opposite direction by means of said backup sleeve and is forced to move in the former direction through the axial bore in the die block.

3. A gear-forming apparatus, comprising:

a die block formed with an axial bore having a predetermined diameter and a plurality of teeth radially projecting into the bore;

a hollow cylindrical punch sleeve having a flat end face and axially aligned with the bore in the die block, the punch sleeve having a predetermined inside diameter and a predetermined outside diameter substantially equal to the diameter of the bore in the die block;

an elongated mandrel axially aligned with the bore in the die block and having a diameter substantially equal to the inside diameter of the punch sleeve; and a cylindrical backup sleeve having a flat end face and a predetermined outside diameter smaller than the diameter of the deddudum circle of said teeth;

the die block and each of the punch sleeve and mandrel being axially movable with respect to each other and to said die block.

4. A gear-forming apparatus, comprising:

a stationary die block formed with an axial bore having a predetermined diameter and a plurality of teeth radially projecting into the bore;

a hollow cylindrical punch sleeve having a flat end face and axially aligned with the bore in the die block, the punch sleeve having a predetermined inside diameter and a predetermined outside diameter substantially equal to the diameter of the bore in the die block and being axially movable toward and away from one axial end of the bore in the die block;

an elongated mandrel axially aligned with the bore in the die block and having a diameter substantially equal to the inside diameter of the punch sleeve; and a cylindrical backup sleeve having a flat end face and a predetermined outside diameter smaller than the diameter of the deddendum circle of said teeth, the backup sleeve being axially movable into and out of the bore in the die block through the other axial end of the bore.

* * * * *